United States Patent [19]

Schoenrock et al.

[11] 3,997,357

[45] Dec. 14, 1976

[54] CONTINUOUS PROCESS FOR THE RECOVERY OF SUGAR FROM MOLASSES

[75] Inventors: Karlheinz W. R. Schoenrock; Chia-Lung Hsieh; Hugh G. Rounds, all of Ogden, Utah

[73] Assignee: The Amalgamated Sugar Company, Ogden, Utah

[22] Filed: Oct. 17, 1975

[21] Appl. No.: 623,410

[52] U.S. Cl. ..... 127/47

[51] Int. Cl.[2] ..... C13J 1/04

[58] Field of Search ..... 127/47

[56] References Cited

UNITED STATES PATENTS

| | | | |
|---|---|---|---|
| 1,757,979 | 5/1930 | Steffen | 127/47 |
| 1,850,036 | 3/1932 | Steffen | 127/47 |
| 2,000,202 | 5/1935 | Vazquez | 127/47 |
| 2,016,609 | 10/1935 | Meredith | 127/47 |
| 2,938,817 | 5/1960 | Thomson | 127/47 |
| 3,687,727 | 8/1972 | Vandewyer | 127/47 |
| 3,844,835 | 10/1974 | Duchateau | 127/47 |

*Primary Examiner*—Morris O. Wolk
*Assistant Examiner*—Sidney Marantz
*Attorney, Agent, or Firm*—Pierce, Scheffler & Parker

[57] ABSTRACT

In obtaining calcium saccharate from molasses solution, active CaO, in the form of burned lime, hydrated lime or milk of lime, is added to the solution; the mixture is cooled to below 20° C.; a stream of slurry of finely subdivided lime ground in an inert organic liquid carrier is injected into a stream of the aforesaid mixture; the cold combined stream is passed through a motionless static mixer; and the so-mixed combined stream is filtered to remove precipitated calcium saccharate.

6 Claims, 1 Drawing Figure

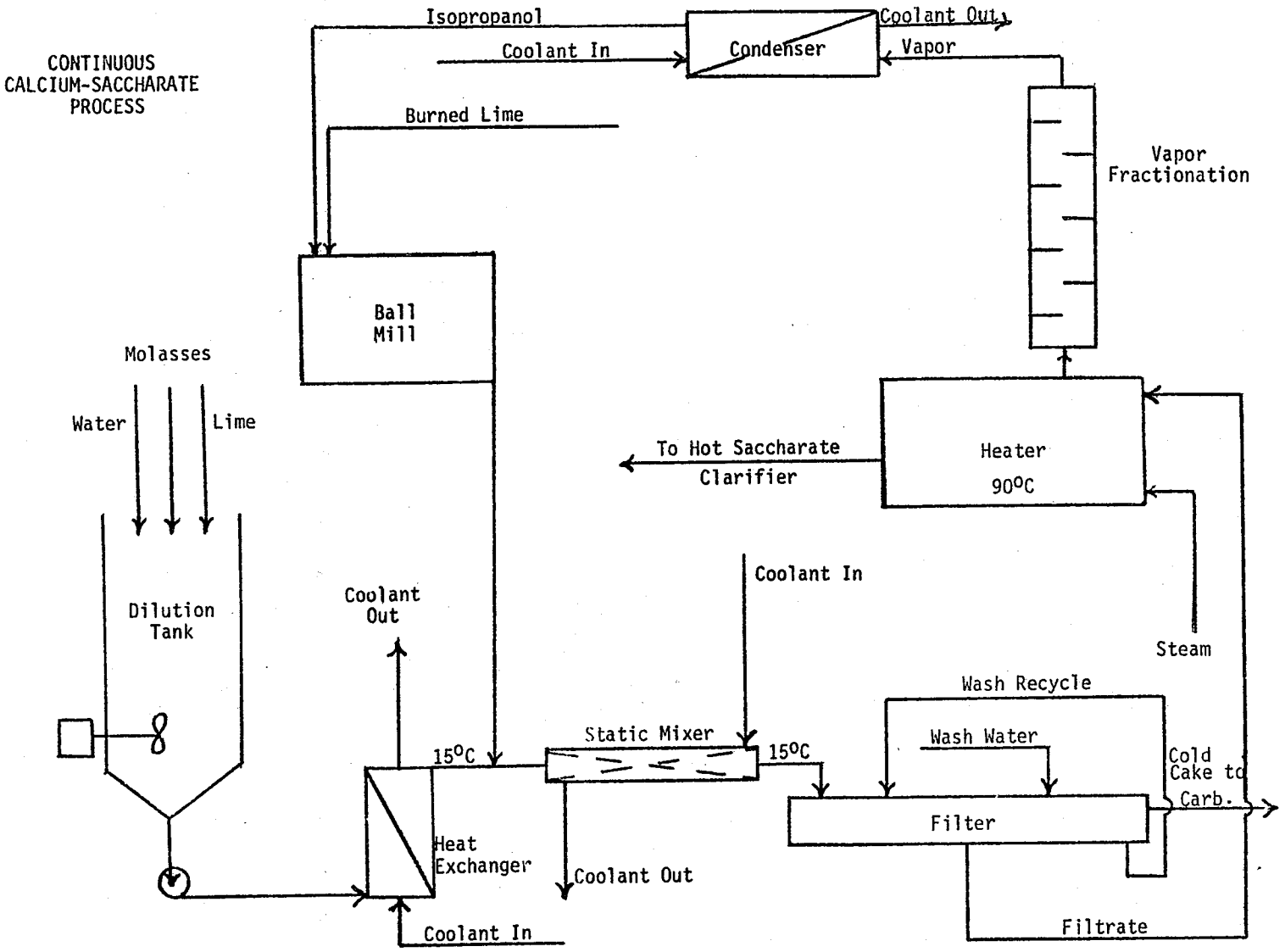
CONTINUOUS CALCIUM-SACCHARATE PROCESS

CONTINUOUS PROCESS FOR THE RECOVERY OF SUGAR FROM MOLASSES

This invention relates to the sugar producing art, and is concerned with improvements in the process of recovering sucrose from molasses.

The exhaustion of sucrose in molasses through crystallization is limited by the solubility of the sucrose in the residual impurity solution. It is known that sucrose can be separated from the major portion of the impurities with which it is associated in molasses through formation of an insoluble salt complex thereof with the alkaline-earth metals. U.S. Pat. No. 277,521 granted in 1883 and U.S. Pat. No. 294,159 granted in 1884 cover a process for the precipitation of sugar from a diluted molasses solution through the addition of finely powdered, dry, highly active calcium oxide. Other processes are known using strontium or barium hydroxide as the precipitant.

It is also known that this reaction deteriorates with decreasing atomic weight of the alkaline-earth metal. Therefore, insoluble saccharates of magnesium and beryllium do not form on reaction of the oxide or hydroxides of either of these metals with sucrose. Other processes reacting finely powdered calcium oxide with a diluted molasses solution and featuring continuous or semi-continuous operation are also known.

We have now discovered a new process for the reaction of a molasses solution with calcium hydroxides and calcium oxides which: (1) eliminates the need for finely powdered, dry calcium oxides; (2) allows substantially increased concentration of the molasses solution; (3) improves the separating efficiency of the precipitated calcium sucrose complex from the residual impurity solution; (4) features continuous operation; (5) reduces the amount of CaO needed and the conventional cooling requirements, respectively. The process is predicated upon grinding a portion of the required burned lime in an inert liquid carrier and adding this slurry to the molasses while the remaining portion of the required burned lime is first added to the molasses solution unground or in the form of milk of lime. The ground lime slurry is added to a cooled mixture of lime and molasses and immediately mixed to form an easily filtering precipitate of calcium saccharate.

The invention will now be described in further detail with reference to the accompanying drawing, in which the single FIGURE illustrates a diagram of the process.

The conventional process normally requires considerably more than 100%, e.g., about 150%, CaO based on the weight of the sugar in the molasses solution to be treated. We have been able with our process to reduce the amount of CaO required to less than 80% CaO based on the sugar content (i.e., 80% CaO on sugar) while maintaining a sugar yield of better than 95%. As a general rule, our process operates at equal efficiency and under equal condition of optimum process control with about 20% less CaO/sugar than does the conventional process.

The sugar concentration of the aqueous molasses solution used for our process may be as low as 6%, or it may be as high as 20%, but is preferably held around 10% to facilitate separation of the precipitate from the impurity solution.

In the following, the process will be detailed relative to its features and operating parameters.

Between 30% and 50% of the total CaO used in the process is added, to an aqueous molasses solution, containing 6–20% sugar, either as unground burned lime or as lime hydrate or as milk of lime. The addition of burned lime releases 15.2 Kcal per mol CaO during the slaking process and requires cooling of the mixture below about 20° C. before the final reaction.

The remaining required CaO representing between 40–60% CaO/sugar is ground as active burned lime with an inert liquid carrier selected from a large group of organic liquids including alcohols, ketones, amines, glycols, aromatic as well as aliphatic hydrocarbons, chlorinated hydrocarbons and ethers, at a lime-to-liquid carrier weight ratio of from 0.5 – 2.5, in a suitable grinder such as a ball mill, for a period of from 0.5 – 2 hours. The ground lime slurry is continuously added to a continuous stream of cooled molasses/lime mixture prepared as outlined in the above paragraph, and at a rate to establish a final CaO sugar ratio in the range of from 0.6 to 1.2. However, at least 50% CaO/sugar should be furnished in the form of the above-described lime slurry in the inert organic solvent carrier.

Immediately after joining the lime slurry stream with the molasses-lime stream, the mixture is forced through a motionless, static in-line mixer where a homogeneous mixture is formed without any significant shear. Among suitable mixers of this type are those made in accord with the disclosures in U.S. Pat. Nos. 3,286,992, 3,404,869, 3,664,638 and 3,704,006. The desideratum is that mixing be effected with a minimum of shearing of the particles of precipitate.

Insoluble calcium saccharate is formed in passage through the motionless, static mixer. An additional retention time of from ½ to 5 minutes at a temperature of less than 20° C. may be useful under some circumstances.

The insoluble calcium saccharate so formed is separated from the residual impurity solution over a vacuum-operated horizontal belt filter or rotary drum filter, and washed on the filter with water to displace the residual impurity solution (mother liquor) from the filter cake of calcium saccharate. This portion of the complete process is called the "cold reaction".

The filtrate is heated in a heater to a temperature of 80° – 95° C. with steam to drive off the organic carrier as a vapor, while residual soluble calcium saccharate is precipitated by the heat. The vapors are fractionated, cooled, condensed, and further processed if required to separate the organic carrier from the water. The recovered organic carrier is recycled to the lime grinding operation.

The recovered liquid carrier recycled to the lime grinding operation must be sufficiently free of water to prevent any slaking of the lime during the grinding operation, hence being inert to the active CaO. It was found that the binary mixture of isopropanol and water need not be broken to be suitable for the grinding process.

The precipitated hot calcium saccharate in the solution emanating from the heater is separated by decantation in a clarifier and subsequent filtration, and is combined with the calcium saccharate filter cake obtained from cold reaction.

Organic liquid used as carrier in the lime grinding operation may also be separated by decantation at this point if it is immiscible with water and has a sufficiently low vapor pressure not to be distilled off in the heater.

EXAMPLE 100 lbs of sugar beet molasses containing 50 lbs of sugar and 35 lbs of dissolved impurities is diluted to 500 lbs with water to make a diluted molasses solution containing 10% sugar. To this solution is added 22.5 lbs of hydrated lime or 15 lbs of burned lime being 100% active CaO. The mixture is equilibrated with the temperature adjusted to 10° C. and thereafter is pumped at a flowrate of 4 liters per minute through a .5 inch diameter jacketed static mixer containing 12 elements, cooling water at 5° – 15° C. being circulated through the jacket.

A uniform stream of lime slurry prepared by grinding 27.5 lbs of burned lime being 90% active CaO and ground with 15 lbs of isopropanol in a ball mill for one hour, is injected into the molasses/lime mixture just ahead of the static mixer at a rate of about 0.350 liter per minute. At this flowrate and at a temperature of about 15° C., the pressure drop through the static mixer is about 25 psi. The discharge from the static mixer is filtered thereafter on a vacuum filter.

The filtered calcium saccharate is adequately washed to displace the mother liquor. The combined filtrate and wash water are heated in a vessel by steam injection to 90° C. until all isopropanol is driven off. The vapors from the heated vessel are fractionated, cooled, and condensed. The recovered binary isopropanol/water is recycled to the ball mill for further lime grinding.

The heated filtrate/wash water is again filtered after all isopropanol has been distilled off. The filtered out residue (calcium saccharate) is washed and combined with the filter cake from the cold filtration. The final filtrate contains less than 2 lbs of the original sugar and about 25 – 30 lbs of the original impurities.

The sugar in the calcium saccharate is, as is well known, released through treatment with carbon dioxide.

The basic process is not significantly altered through the use of other inert organic liquid carriers than the isopropanol of the above specific example. The only process variation would apply to the recovery of the inert lime carrier. Liquids with very high boiling points may not be conveniently distilled off (although even that is possible with steam distillation) and are better suited for decantation if immiscible. The recovery of the carrier, however, is not essential to the process and merely improves operating costs. Conditions could prevail where its disposal is desirable. Other carriers would function very similarly to isopropoanol given in the example relative to the basic process which is the reaction of the lime in the inert carrier with the mixture of sugar and lime.

Economics dictates the use of as little carrier as practical. However, any concentration is operable — even to the point of toothpaste-like consistency — as long as it can be transferred by some form of a pumping system.

While economy in lime usage is important, a main factor in our improved process is that only about 50% CaO/sugar needs to go through the grinding process. The grinding of lime increases the expense of the operation (investment, maintenance, labor, dust control). Furthermore, wet grinding is far more efficient and uniform than is dry grinding.

In the conventional process, there is violent agitation which shears the precipitated particles thus deteriorating filtration rates. This limits the sugar concentration in the molasses to be treated to about 6%. Our new process does not expose the precipitated particle to shear; hence, greatly improving filtration, washing of cake, etc. All these factors contribute to increase the purity of the cake, the concentration of the waste mother liquor which then in turn requires less energy, plant equipment, etc., to concentrate the waste solution to a cattle feed. Again, however, the adjustment of the sugar concentration, like the CaO/sugar ratio, is dependent upon specific plant preference and requirements.

In our process the economical optimum is around 10% sugar, in the molasses solution; 30% CaO/sugar in the preaddition and 50% CaO/sugar as a slurry in the inert carrier, with the smallest amount of inert liquid carrier required to obtain a good grinding action, - the latter being dependent upon the equipment used, e.g. ball mill, roller mills, etc., and the type of liquid used. These factors, in general, however, do not significantly alter the basic process but are subject to user preference and his specific economics. The basic process maintains its advantages throughout the wide ranges of these parameters.

It would be possible to add all of the needed lime, to the molasses solution, in the form of the above-described ground slurry of burnt lime in inert organic liquid carrier, and in such case a 70% CaO/sugar ratio would be sufficient. However, the over-all economy would not be acceptable.

The major benefits of our process are as follows:

1. True continuous operation.
2. Low investment cost.
3. Low operating cost.
4. Increased product purity.
5. Increased capacity per basic operating unit.
6. Simplified operation reduced impact of operator error.
7. Increased concentration lowered energy requirement for cooling and evaporation.

We claim:

1. A continuous process for the precipitation and recovery of calcium saccharate from molasses which comprises treating an aqueous molasses solution containing 5 – 20% by weight of sugar with 15 – 50% of the active CaO required to react with the sugar in the molasses, the active CaO being added to the aqueous molasses solution in the form of burned lime, hydrated lime or milk of lime, cooling the molasses/lime mixture to below 20° C., injecting into a continuous first stream of this molasses/lime mixture a second stream of a slurry of ground lime in an organic liquid carrier, said carrier being inert to CaO and to sugar, said ground lime slurry injected being sufficient to provide 40 – 70% of the active CaO required to react with the sugar in the molasses, passing the combined streams through a motionless, static mixer to obtain homogeneity of the cool mixture containing the resulting precipitated calcium saccharate, maintaining the temperature below 20° C. throughout, filtering the cool mixture containing the precipitated calcium saccharate and washing the resulting cold filter cake.

2. The process defined in claim 1, wherein said slurry is prepared by grinding active burned lime in the inert organic liquid carrier, at a weight ratio, respectively, of from 0.5:1 to 2.5:1, for a period of from 0.5 to 2.0 hours.

3. The process defined in claim 1, wherein the inert organic liquid carrier is isopropanol.

4. The process defined in claim 1, which further comprises heating the resulting filtrate and the wash water from the cool filter cake thereby precipitating the residual soluble saccharate, vaporizing and expelling the inert organic liquid carrier and water, collecting the combined vapors and fractionating, cooling and condensing the vapors to recover the organic liquid carrier and recycling the so-recovered carrier in the preparation of said slurry, filtering and washing the hot precipitated saccharate, and combining the filter cake of hot precipitated saccharate with the cold saccharate filter cake.

5. The process defined in claim 1, which further comprises decanting the cool filtrate and cool wash water to recover water-immiscible inert organic liquid carrier; recycling such recovered carrier to the lime grinding operation and processing the water-bearing fraction for recovery of saccharate.

6. The process defined in claim 1, wherein the organic liquid carrier is a member selected from the group consisting of alcohols, ketones, amines, glycols, aromatic hydrocarbons, aliphatic hydrocarbons, chlorinated hydrocarbons and ethers inert to CaO and to sugar.

* * * * *